US005555750A

United States Patent [19]

Fischer et al.

[11] Patent Number: 5,555,750

[45] Date of Patent: Sep. 17, 1996

[54] METHOD AND MACHINE FOR WARP KNITTING FABRIC AND CUTTING PATTERN THREADS

[75] Inventors: Joachim Fischer, Rodgau; Ingo Mayer, Heusenstamm, both of Germany

[73] Assignee: Karl Mayer Textilmaschinenfabrik GmbH, Obertshausen, Germany

[21] Appl. No.: 526,545

[22] Filed: Sep. 8, 1995

[30] Foreign Application Priority Data

Sep. 10, 1994 [DE] Germany ..... 44 32 222.4

[51] Int. Cl.[6] ..... D04B 21/06; D04B 27/06; D04B 35/34

[52] U.S. Cl. ..... 66/145 B; 66/203; 66/145 S

[58] Field of Search ..... 66/145 B, 145 S, 66/141, 142, 143, 125 R, 203, 204, 83, 214

[56] References Cited

U.S. PATENT DOCUMENTS

| | | | |
|---|---|---|---|
| 2,674,866 | 4/1954 | Dyjak | 66/154 B |
| 2,690,660 | 10/1954 | Miller | 66/145 B X |
| 2,844,016 | 7/1958 | Cobert | 66/145 B X |
| 2,934,922 | 5/1960 | Reading, Jr. | 66/145 B |
| 4,581,905 | 4/1986 | Boaschi | 66/203 |

FOREIGN PATENT DOCUMENTS

| | | | |
|---|---|---|---|
| 1148690 | 10/1959 | Germany | 66/145 B |
| 56044 | 5/1967 | Germany . | |
| 1585397 | 12/1969 | Germany . | |
| 3812124 | 10/1989 | Germany . | |
| 4008058 | 9/1991 | Germany . | |
| 605248 | 7/1948 | United Kingdom | 66/145 B |

*Primary Examiner*—John J. Calvert
*Attorney, Agent, or Firm*—Omri M. Behr, Esq.

[57] ABSTRACT

At least one pattern thread (8) is bound into the fabric ground in a process for producing a patterned knitted fabric (12). The process uses a warp knitting machine having one needle bar (1), at least one fabric ground laying bar (2,3*a*), at least one pattern laying bar (9) carrying guides (7) for pattern threads and a knock-over arrangement (9) over which the fabric (12) can be pulled. The pattern thread (8) is grasped, by a grasping device (16), and held between the pattern thread guide and the knock-over arrangement (9). The grasped pattern thread is then severed proximal to the knock-over arrangement, by a cutting device (13). The severed pattern thread is held out of the knitting process for a predetermined time, before being bound again into the fabric ground, no earlier than after a new stitch formation. The excess pattern thread is again severed near the knock-over arrangement (9) and the freed thread cuttings removed. Also disclosed is a warp knitting machine for the formation of such a patterned fabric. In effect, a single pattern thread (8) can form pattern segments which are separate from each other. This is achieved in a cost effective and space saving manner, as well as with reduced thread loss.

18 Claims, 3 Drawing Sheets

METHOD AND MACHINE FOR WARP KNITTING FABRIC AND CUTTING PATTERN THREADS

FIELD OF THE INVENTION

The present invention is directed to (a) a process for the production of patterned warp knitted fabric in which at least one pattern thread is bound into the fabric ground, on a warp knitting machine having one needle bar, at least one fabric ground laying bar, at least one pattern laying bar carrying guides for pattern threads and a knock-over arrangement over which the fabric can be pulled; and (b) a warp knitting machine for the production of a patterned fabric having a needle bar, at least one guide bar for laying the ground pattern of the fabric ground, at least one pattern bar carrying the guides for the pattern threads, and a knock-over arrangement over which the fabric can be pulled.

BACKGROUND OF RELATED ART

It is known in the prior art to provide knitted goods with a pattern employing pattern threads that are bound into a fabric ground. For this purpose, the warp knitting machine is provided with a pattern guide bar for all similarly laid pattern threads. The pattern threads are supplied to the needles by pattern thread guides and either grasped as a partial weft or knotted as in a stitch. Each pattern thread must be laid over the entire breadth of the fabric with the consequence that where no pattern is desired, the pattern threads must run with the fabric ground or as a float upon the fabric ground.

Therefore, it has been known (DE OS 15 85 397) to form a pattern fabric of the type under consideration, at the exit of the warp knitting machine. In the first work step, the floating threads are cut through and in the second working step are suctioned up and cut back up to the fabric ground. In this manner, each pattern thread forms pattern segments which are separated from each other by free areas. Such a procedure however is bound up with substantial expenditure and space utilization. Furthermore, relatively long fabric segments are cut out which leads to a waste of pattern thread.

The purpose of the present invention is to provide warp knitted fabrics, which have separated pattern segments but are created in a simple manner and waste less pattern thread.

SUMMARY OF THE INVENTION

In accordance with the illustrative embodiments demonstrating features and advantages of the present invention, there is provided a process for producing a patterned knitted fabric having at least one pattern thread bound into a fabric ground. The process employs a warp knitting machine having a needle bar, at least one fabric ground laying bar, at least one pattern laying bar carrying pattern thread guides, and a knock-over arrangement over which fabric can be pulled. The process includes the step of grasping pattern thread between the pattern thread guides and the knock-over arrangement. Another step is severing pattern thread proximal to the knock-over arrangement. The process includes the step of holding pattern thread that was cut proximal the knock-arrangement for a predetermined time, out of a knitting process performed by the warp knitting machine. Another step is binding again into the fabric ground, pattern thread held for the predetermined time. The process also includes the step of cutting again through pattern thread near the knock-over arrangement no earlier than after a new stitch formation and removing freed cuttings of pattern thread.

According to another aspect of the invention, there is provided a warp knitting machine for the formation of patterned fabric having at least one pattern thread bound into a fabric ground. This machine includes a needle bar and at least one guide bar for laying a ground pattern for the fabric ground. Also included is at least one pattern bar having a plurality of pattern thread guides for the pattern threads. The machine also has a knock-over arrangement over which fabric can be pulled. Also included is at least one controlled grasping means for grasping pattern thread between the pattern thread guides and the knock-over arrangement. The machine also has a cutting arrangement proximal to the knock-over arrangement for severing pattern thread held by the gripping means close to the fabric ground.

The above procedure may be accomplished by a process wherein the pattern thread is grasped, held between the pattern thread guide and the knock-over arrangement, severed proximal to the knock-over arrangement, held out of the knitting process for a predetermined time, then again bound into the fabric ground, again cut through near the knock-over arrangement no earlier than after a new stitch formation, and the freed thread cuttings segment liberated.

A preferred warp knitting machine can form such patterned fabric with at least one pattern thread bound into the fabric ground. The machine has a needle bar, at least one guide bar for laying the ground pattern of the fabric ground, at least one pattern bar carrying the guides for the pattern threads, and a knock-over arrangement over which the fabric can be pulled.

In this procedure, it is unnecessary to lay the pattern thread in the pattern free areas, as floats. Rather, thread is removed in a timely manner from the knitting process and only bound into the fabric ground at the desired point in time. Thus, the loss in pattern thread material is exceedingly low. In both cutting procedures, the pattern thread is anchored on one end in the fabric ground and on the other end, held in a gripping position. This allows for a clean cutting arrangement. It is possible to cut exceedingly short thread segments. The constructive complexity and space utilization are very small since the pulled-off fabric can be readily guided onto the knock-over arrangement and still leave enough room in the knitting work area for the provision of the necessary construction for grasping and cutting.

The removal by suction of the cuttings of the pattern thread avoids a collision between these cuttings and the rest of the provided threads.

In order that the pattern threads are held outside the knitting process for the proper time period, one must ensure that they are not grasped by the needle. Two particularly simple solutions to this problem are provided (a) by holding the pattern thread out of the knitting process by suppression of the overlap displacement; or (b) by a vertical displacement of the pattern thread guide.

The further development of the use of jacquard controlled pattern thread guides where at least one pattern thread takes part in the knitting process, while another pattern thread is held out of the knitting process, making it possible to reduce the number of required pattern guide bars since as a result of jacquard control, pattern threads can be laid in a different pattern at the same time. Since the cutting arrangement only grasps the non-bound pattern threads, the pattern formation of the remaining pattern threads is not influenced thereby.

Also, a suction removal arrangement is provided between the grasping means and the cutting arrangement. It is sufficient to provide a single cutting and suction removal arrangement for all pattern threads which stretches over the entire width of the machine. Therefore, while the gripping means must individually act upon the pattern threads, there is no reason not to provide a commonly activated cutting arrangement.

A control arrangement, which activates the grasping means and the cutting arrangement in accordance with the pattern laying of the pattern thread, ensures the proper coordination of the movement of the pattern thread guides, the gripping means, and the cutting arrangement.

A jacquard control of the pattern guides permits a reduction in the number of pattern guide bars.

BRIEF DESCRIPTION OF THE DRAWINGS

The invention is described in further detail in the drawings of the preferred embodiments which show.

DETAILED DESCRIPTION OF THE PREFERRED EMBODIMENTS

Figure 1:
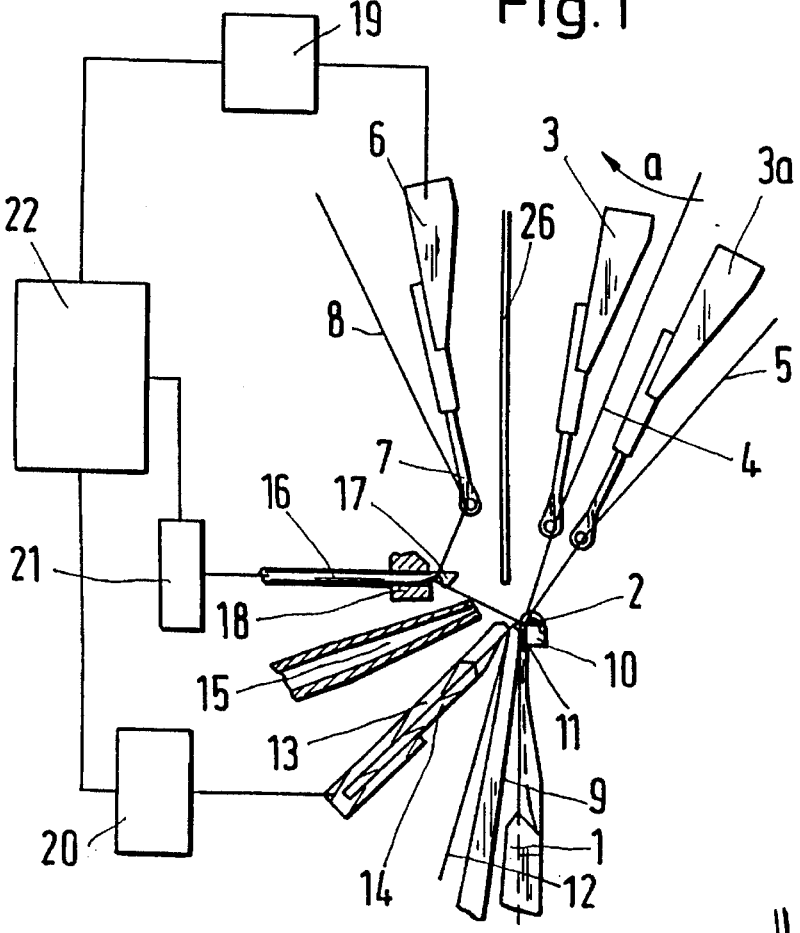
FIG. 1 is a schematic diagram of the working area of a warp knitting machine equipped and arranged to perform in accordance with the principles of the present invention.

FIGS. 1 to 4 show the working area of a conventional warp knitting machine in which, a needle bar (1) works together with needles (2), two guide bars (3 and 3*a*) whose guides provide threads (4) and (5) for the formation of the groundware. This groundware may be, for example, tricot, "tuch," or preferably, fringe in combination with weft insertion.

A pattern guide bar (6) has pattern guides (7) and pattern threads (8) for forming a pattern. Furthermore, there is provided a trick plate (26). The knock-over arrangement (9) carries knock-over sinkers (10) and a knock-over edge (11) over which the finished fabric (12) is pulled.

A novel feature of the present invention is to provide next to the knock-over arrangement (9) at least one, but preferably, a plurality of cutting arrangements (13) with scissors (14) which, for example, have a stationary and a mobile segment. A suction arrangement (15) in the form of a suction jet has a mouth in the vicinity of knock-over edge 11. The suction arrangement (15) extends across the working width of the machine.

At least one, but preferably a plurality of, gripping means (16) has a hook (17) for grasping the pattern thread (8) and holding it by drawing it into a clamping box (18).

The individual pattern thread guides (7) on pattern guide bar (6) are displaceable by a pattern dependent setting arrangement (19) shown in FIG. 1. In particular, one is concerned here with a jacquard guide bar. The cutting knife (14) is activated by a setting motor (20) and the gripping means (16) by a setting motor (21). A control arrangement (22) coordinates the motion of the pattern thread guides, the cutting arrangement (13) and the gripping means (16).

Arranged in this fashion, at least one controlled grasping means (16) can grasp one pattern thread (8) between the pattern guide (7) and the knock-over arrangement (9) and the cutting arrangement (13) proximal to the knock-over arrangement (9) can sever the pattern thread (8), held by the gripping means (16), close to the fabric ground. Significantly, the controlled gripping means and the cutting arrangement are located in the region of the knock-over arrangement.

In FIG. 1, the needle (2) is located shortly before the knock-over arrangement. The guide bars (3, 3*a* and 6) swing in the direction of arrow (a) into the front-most position, that is, into the underlap position.

Figure 2:
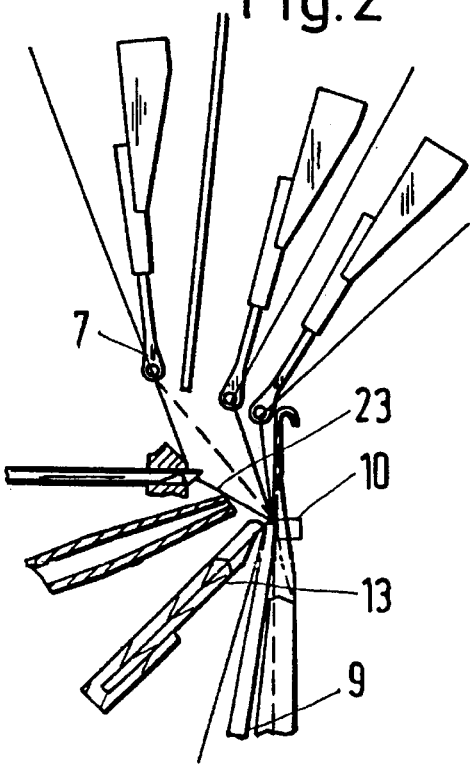
FIG. 2 is a schematic diagram of the arrangement of FIG. 1 with the guides moved to the underlap position.

When the lapping of a pattern segment by the pattern thread (8) is completed, the gripper (16) grips this pattern thread (8) in the area between the pattern thread guide (7) and the knock-over arrangement (9) and pulls it into the clamping box (18) where it is held fast. This is shown in FIG. 2 where the guide bars are shown in the underlap position. Then the cutting arrangement (13) cuts the thread segment (23), which is held between the knock-over edge (11) and the gripper (16) near the knock-over arrangement (9), close to the knock-over edge (11).

Figure 3:
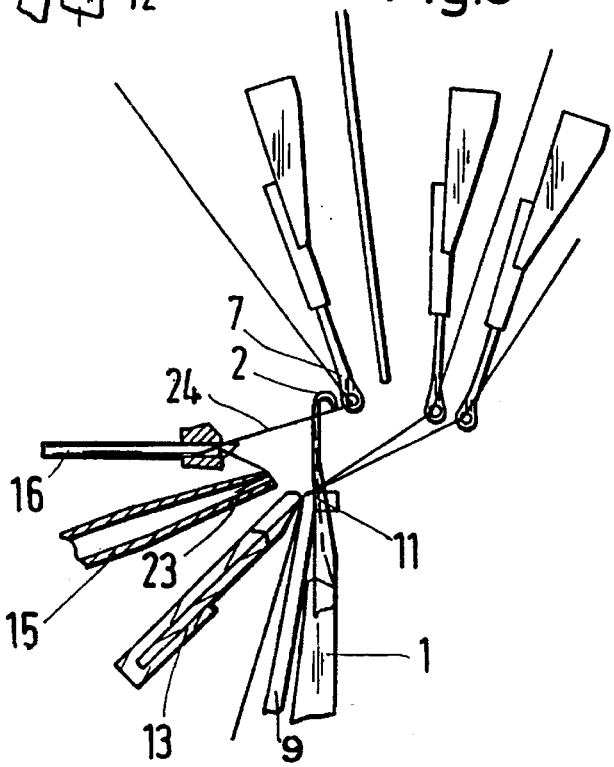
FIG. 3 is a schematic diagram of the arrangement of FIG. 1 with the guides moved to the overlap position and with a pattern thread severed.
Figure 4:
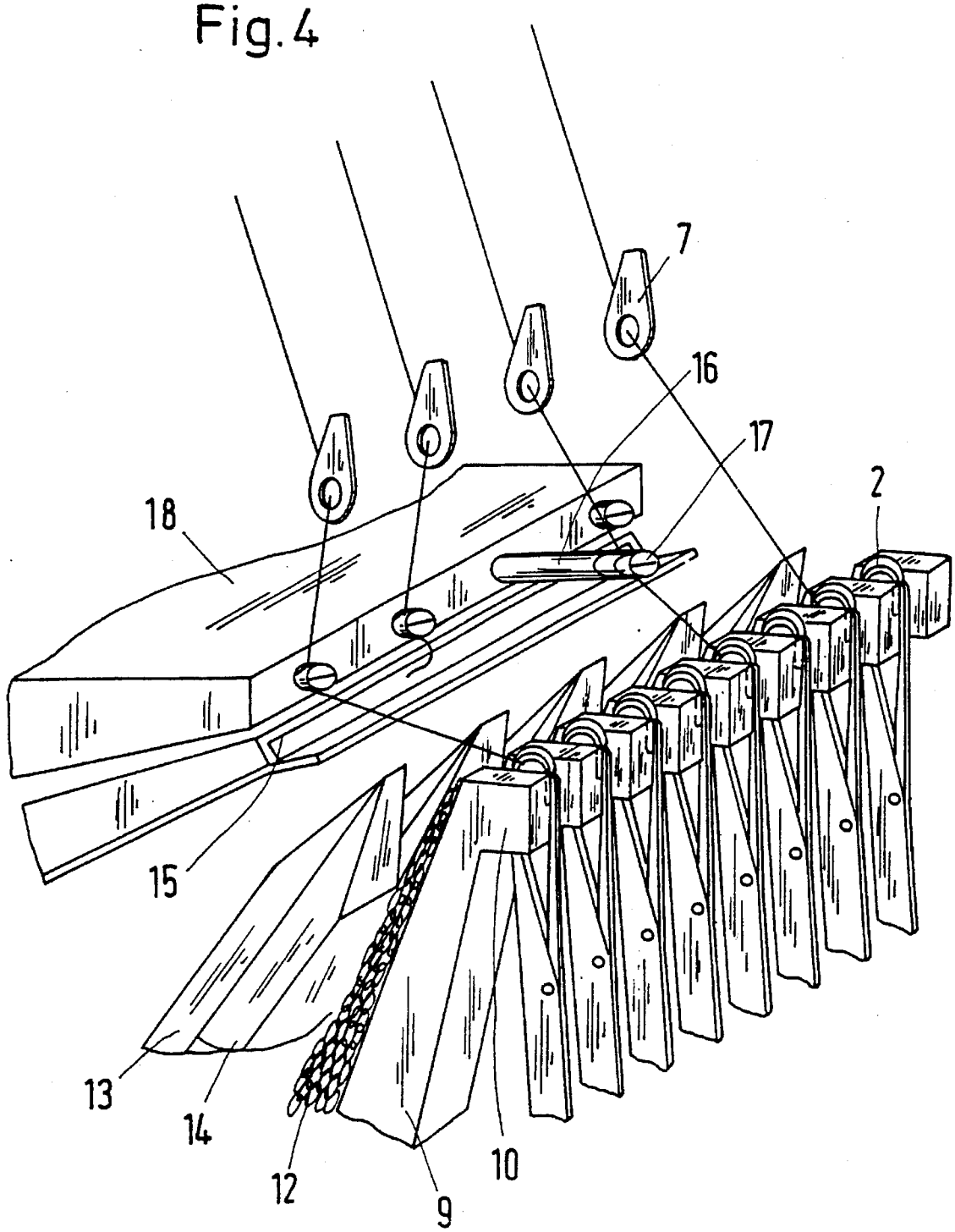
FIG. 4 is an upper perspective view of the working area of FIG. 1.

The thread segment (23) is removed by a suction arrangement (15). This is shown in FIG. 3 wherein the guide bars are in the overlap position. The pattern thread guide (7) is now moved that further knitting is prevented, that is, the thread segments not needed at the moment are taken out of the knitting arrangement. This occurs either by a height displacement of the pattern thread guide (7) or by a sideward displacement so that no overlap occurs. Both types of control can be achieved by Jacquard controls in a manner that is well known.

As soon as a new pattern is to be started, the pattern thread guide (7) is brought into a position in which the needle (2) of the needle bar (1) grasps the pattern thread segment (24) between the gripping means (16) and the pattern thread guide (7). As soon as this thread segment (24) is bound into a working cycle, preferably however, only after several knitting steps, the cutting arrangement (13) is again activated and cuts the thread (24) tensioned between the knock-over edge (11) and the gripper (16) close to the knock-over edge (11). As soon as the gripper (16) is extended to the release position, the severed, relatively short thread pattern cuttings (23, 24) disappear entirely into the suction arrangement (15).

Figure 5:
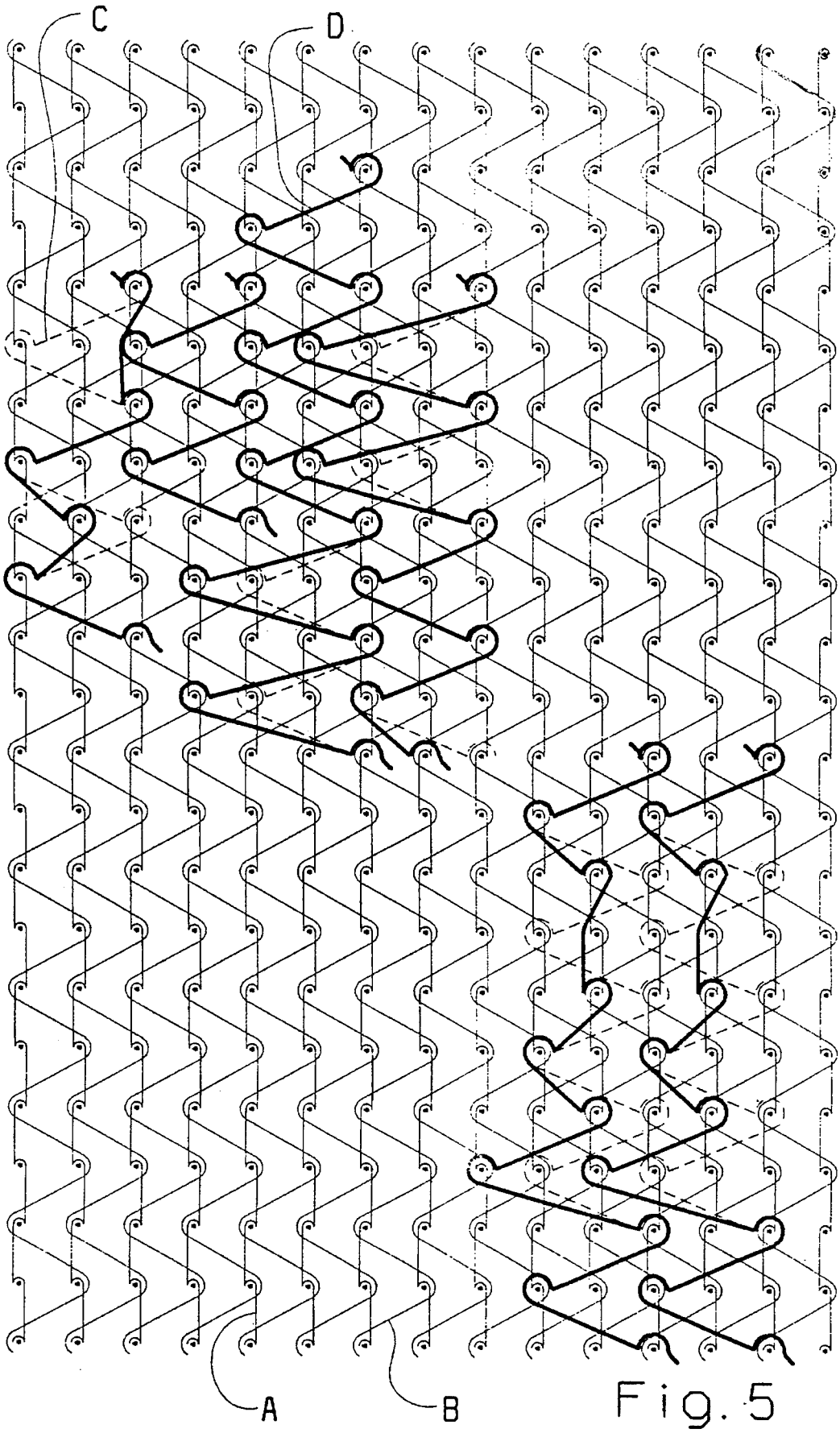
FIG. 5 is a lapping diagram of a finished fabric of this invention.

FIG. 5 shows a lapping diagram of fabric produced by this method. The fabric ground comprises fringe (A) and a partial weft insert (B). The basic pattern (C) of the pattern guide bar (6) is shown in phantom. This bar (6) is formed as a Jacquard guide bar, and the actual pattern lap (D), which differs from the basic pattern, is shown in bold lines. It is important that the threads of the pattern lap (D) only run over the longitudinal segments of the pattern path. No pattern threads are run between these longitudinal segment areas.

In the working example, gripper (16) is shown as a clamping hook. It can however have other forms, for example, clamping tongs. The cutting arrangement (13) is shown as a knife, however scissors may also be used. In the working example the pattern guide bar associated with the gripper (16) and the cutting arrangement (13), each have their own setting motor. One may however, also operate with a switching arrangement driven by the machine shaft.

It is also not necessary to require the cutting arrangement to be activated. The activation of the cutting arrangement can be dependent upon the patterning and at each work cycle bring these into the cutting position.

In order to prevent an overlap by the pattern thread guide (7) the entire pattern guide bar (6) can be appropriately controlled or else the individual pattern thread guides (7) can be moved into an inactive position. Particularly suitable for this purpose is the control arrangement disclosed in German Patent Application P 44 14 876.3-26, in which for each work cycle a first pattern dependent choice of guide bars results which are displaced during the underlap displacement and a second pattern dependent choice of guide needles are displaced during the overlap displacement.

We claim:

1. Process for producing a patterned knitted fabric having at least one pattern thread bound into a fabric ground, and employing a warp knitting machine having a needle bar, at least one fabric ground laying bar, at least one pattern laying bar carrying pattern thread guides, and a knock-over arrangement over which fabric can be pulled, comprising the steps of:

grasping pattern thread between the pattern thread guides and the knock-over arrangement;

severing pattern thread proximal to the knock-over arrangement;

holding pattern thread cut proximal said knock-arrangement for a predetermined time, out of a knitting process performed by said warp knitting machine;

binding again into the fabric ground, pattern thread held for the predetermined time;

cutting again through pattern thread near the knock-over arrangement no earlier than after a new stitch formation; and removing freed cuttings of pattern thread.

2. Process in accordance with claim 1 wherein the step of removing the freed cuttings of pattern thread is performed by suction.

3. Process in accordance with claim 2 wherein the step of holding pattern thread out of the knitting process is performed by suppressing overlap displacement of pattern thread.

4. Process in accordance with claim 2 wherein the step of holding pattern thread out of the knitting process is performed by vertically displacing at least one of the pattern thread guides.

5. Process in accordance with claim 1 wherein the step of holding pattern thread out of the knitting process is performed by suppressing overlap displacement of pattern thread.

6. Process in accordance with claim 1 wherein the step of holding pattern thread out of the knitting process is performed by vertically displacing at least one of the pattern thread guides.

7. Process in accordance with claim 1 wherein at least some of the pattern thread guides are Jacquard controlled, and wherein during the step of holding pattern thread out of the knitting process, some pattern thread participate in the knitting process.

8. Process in accordance with claim 2 wherein at least some of the pattern thread guides are Jacquard controlled, and wherein during the step of holding pattern thread out of the knitting process, some pattern thread participate in the knitting process.

9. Warp knitting machine for the formation of patterned fabric having at least one pattern thread bound into a fabric ground, comprising:

a needle bar;

at least one guide bar for laying a ground pattern for the fabric ground;

at least one pattern bar having a plurality of pattern thread guides for the pattern threads;

a knock-over arrangement over which fabric can be pulled;

at least one controlled grasping means for grasping pattern thread between the pattern thread guides and the knock-over arrangement; and a cutting arrangement proximal to the knock-over arrangement for severing pattern thread held by the gripping means close to the fabric ground.

10. Warp knitting machine in accordance with claim 9 comprising:

a suction arrangement between the grasping means and the cutting arrangement for removing cuttings of pattern thread.

11. Warp knitting machine in accordance with claim 10 wherein the machine has a working width and wherein the suction arrangement extends over the working width of the machine.

12. Warp knitting machine in accordance with claim 11 wherein the machine has a working width and wherein the cutting arrangement extends over the working width of the machine.

13. Warp knitting machine in accordance with claim 9 wherein the machine has a working width and wherein the cutting arrangement extends over the working width of the machine.

14. Warp knitting machine in accordance with claim 10 comprising:

a control arrangement for activating the grasping means and the cutting arrangement in coordination with thread laying motions of the pattern thread guides.

15. Warp knitting machine in accordance with claim 9 comprising:

a control arrangement for activating the grasping means and the cutting arrangement in coordination with thread laying motions of the pattern thread guides.

16. Warp knitting machine in accordance with claim 15 wherein at least some of the pattern thread guides of the pattern bar are jacquard controlled.

17. Warp knitting machine in accordance with claim 10 wherein at least some of the pattern thread guides of the pattern bar are Jacquard controlled.

18. Warp knitting machine in accordance with claim 9 wherein at least some of the pattern thread guides of the pattern bar are Jacquard controlled.

* * * * *